US008837755B2

(12) United States Patent
Jiles et al.

(10) Patent No.: US 8,837,755 B2
(45) Date of Patent: Sep. 16, 2014

(54) APPARATUS IN AN ACOUSTIC ASSEMBLY FOR REGISTERING ASSEMBLY PARTS

(71) Applicant: Knowles Electronics, LLC, Itasca, IL (US)

(72) Inventors: Mekell Jiles, Flossmoor, IL (US); Matthew Mason, Algonquin, IL (US); Phillip M McCratic, Cary, IL (US)

(73) Assignee: Knowles Electronics, LLC, Itasca, IL (US)

( * ) Notice: Subject to any disclaimer, the term of this patent is extended or adjusted under 35 U.S.C. 154(b) by 26 days.

(21) Appl. No.: 13/712,053

(22) Filed: Dec. 12, 2012

(65) Prior Publication Data

US 2013/0195292 A1 Aug. 1, 2013

Related U.S. Application Data

(60) Provisional application No. 61/569,875, filed on Dec. 13, 2011.

(51) Int. Cl.
*H04R 25/00* (2006.01)

(52) U.S. Cl.
USPC ..... 381/176; 381/396; 381/399

(58) Field of Classification Search
CPC .... H04R 25/00; H04R 1/00; H04R 2205/022; H04R 2201/401; H04R 2201/405; H04R 9/025; H04R 9/027; H04R 9/048
USPC ..... 381/182, 176, 395, 191, 396, 417–418
See application file for complete search history.

(56) References Cited

U.S. PATENT DOCUMENTS

| | | | | |
|---|---|---|---|---|
| 4,272,654 | A | 6/1981 | Carlson | |
| 4,410,769 | A * | 10/1983 | Tibbetts | 381/176 |
| 8,098,854 | B2 * | 1/2012 | van Halteren et al. | 381/182 |
| 2004/0086149 | A1 | 5/2004 | Johansen et al. | |
| 2005/0152574 | A1 | 7/2005 | Van Banning et al. | |

FOREIGN PATENT DOCUMENTS

| | | |
|---|---|---|
| EP | 0094992 | 11/1983 |
| JP | 06165283 | 6/1994 |

OTHER PUBLICATIONS

International Search Report for related application No. PCT/US2012/069459, dated Mar. 28, 2013.

* cited by examiner

*Primary Examiner* — Suhan Ni
(74) *Attorney, Agent, or Firm* — Fitch, Even, Tabin & Flannery LLP

(57) ABSTRACT

An acoustic apparatus includes a first acoustic element, a second acoustic element, and a registration portion. The first acoustic element and the second acoustic element are elements such as a coil, a reed, or a yoke. The registration portion is configured to register the first acoustic element with respect to the second acoustic element such that an exact and relative alignment and positioning between the first acoustic element and second acoustic element is provided and ensured.

4 Claims, 13 Drawing Sheets

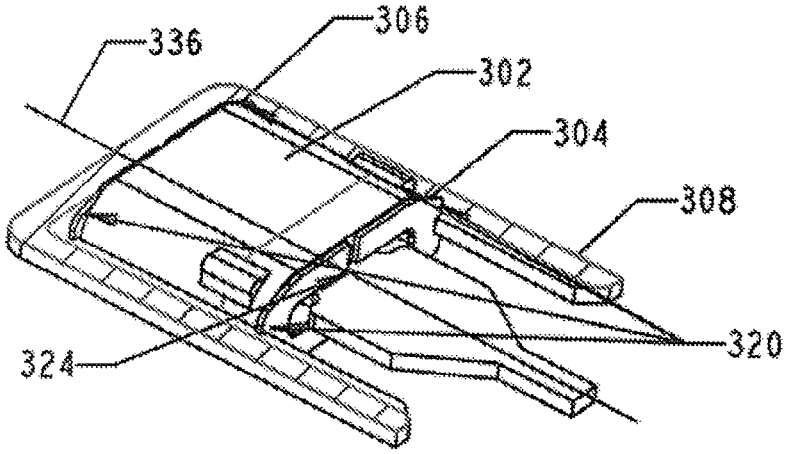
FIG. 3A
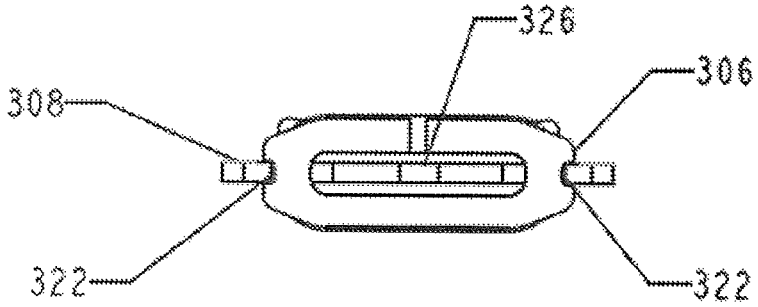
FIG. 3B
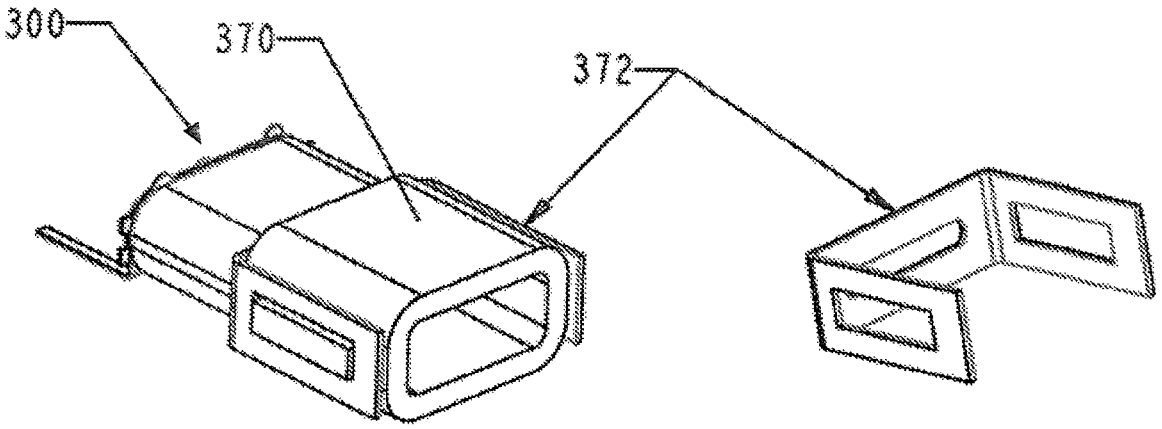
FIG. 3C
FIG. 3D

APPARATUS IN AN ACOUSTIC ASSEMBLY FOR REGISTERING ASSEMBLY PARTS

CROSS REFERENCE TO RELATED APPLICATIONS

This patent claims benefit under 35 U.S.C. §119 (e) to U.S. Provisional Application No. 61/569,875 entitled "Apparatus In An Acoustic Assembly For Registering Assembly Parts" filed Dec. 13, 2011, the content of which is incorporated herein by reference in its entirety.

TECHNICAL FIELD

This application relates to acoustic devices and, more specifically, to their construction.

BACKGROUND OF THE INVENTION

Various types of microphones and receivers have been used through the years. In these devices, different electrical components are housed together within a housing or assembly. For example, a receiver typically includes a coil, bobbin, stack, among other components and these components are housed within the receiver housing. Other types of acoustic devices may include other types of components.

The components that are housed in the interior of the housing are arranged to provide various functions. In this respect, some of these components also must be correctly positioned within precise tolerance ranges relative to other components. For example, the coil, bobbin, and magnets need to be positioned in proximity to each other in order that the acoustic device can function properly. In another example, the coil and reed often need to have a specific positioning relative to each other. Without the correct relative positioning of the components (i.e., within an acceptable tolerance), the acoustic device will not operate properly or will have less than optimal performance.

Previous acoustic devices and assemblies have often been constructed with alignment tolerances that often exceeded acceptable limits and became misaligned. For instance, due to the variation in part sizes, the required tolerances could not be achieved and assembly components often became misaligned. This, in turn led to a detrimental impact on operation of the device. Further, many parts had to be discarded after manufacturing or were returned by customers. All of these problems have led to some user dissatisfaction with these previous approaches.

BRIEF DESCRIPTION OF THE DRAWINGS

For a more complete understanding of the disclosure, reference should be made to the following detailed description and accompanying drawings wherein:

FIG. 3A is a perspective view of a base coil and reed in an acoustic assembly according to various embodiments of the present invention;

FIG. 3B is a front view of a base coil and reed of FIG. 3A in an assembly according to various embodiments of the present invention;

FIG. 3C is a perspective view of a base coil of FIGS. 3A-B with a yoke in an assembly according to various embodiments of the present invention;

FIG. 3D is a yoke plate used in the assembly of FIGS. 3A-C according to various embodiments of the present invention;

Figure 1A:
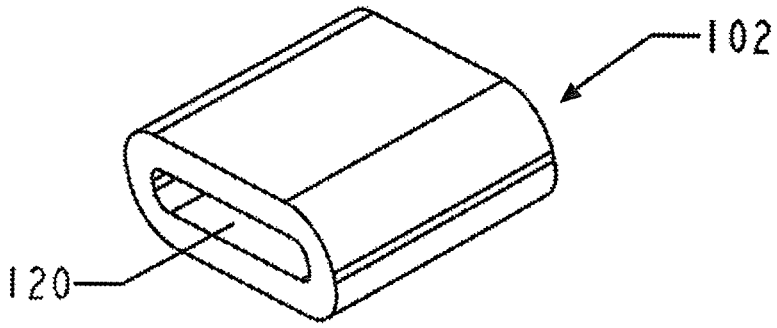
FIG. 1A is a perspective view of a base coil in an acoustic assembly (e.g., a balanced armature transducer) according to various embodiments of the present invention.
Figure 1B:
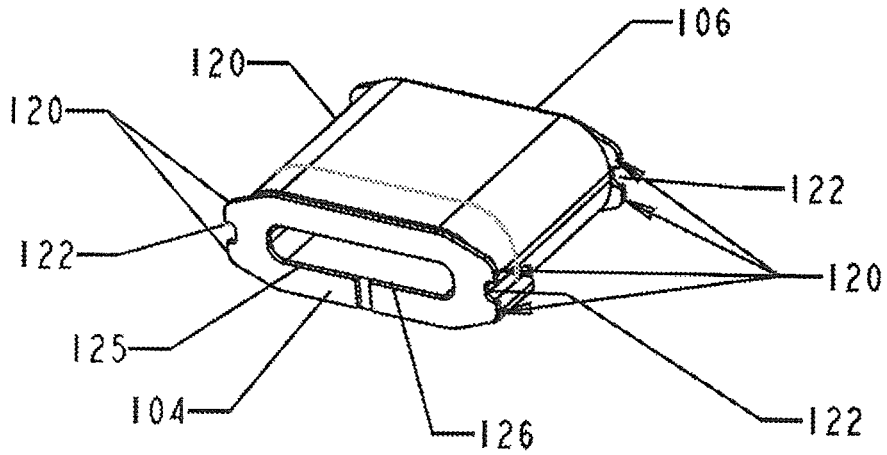
FIG. 1B is a perspective view of the base coil of FIG. 1A with shims in an acoustic assembly according to various embodiments of the present invention.
Figure 1C:
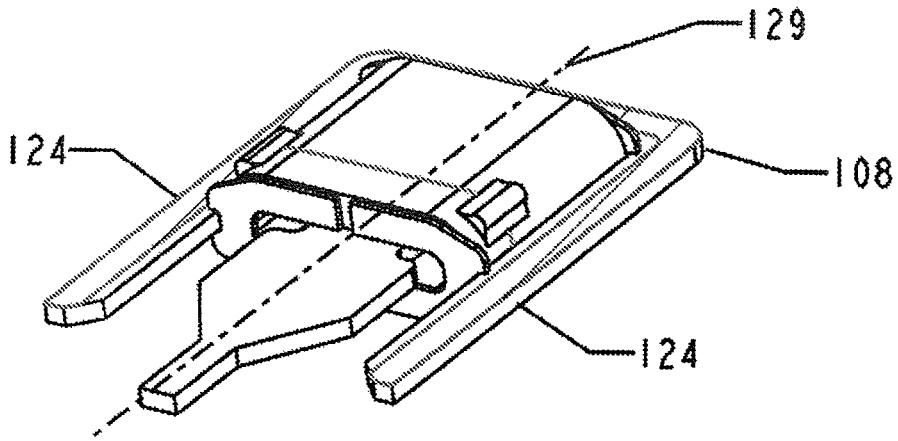
FIG. 1C is a perspective view of the base coil and shims of FIGS. 1A and 1B, and with a flat reed in an assembly according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Acoustic assemblies (e.g., microphones and receivers) and their components are configured to facilitate registration of these components with respect to each other (e.g., the coil and the reed of an acoustic assembly). By "registration" and as used herein, it is meant the relative placement of one component with respect to another component.

More specifically and in one aspect, flanges (or other similar mechanisms) are disposed upon, formed with, constructed with, coupled to, or incorporated with elements of an acoustic assembly thereby facilitating the exact registration and positioning of some parts of the assembly with respect to other parts. For instance, flanges may be coupled to two opposing sides of a coil. The flanges guide or position the reed with respect to the center of the coil and register these components with respect to each other. In this way, the reed and coil will have an exact position with respect to the other and this exact positioning is not disturbed or affected by variations in size of the coil, reed, or any other part of the assembly. In other words, the selected components will have the same placement with respect to each other despite variations in part size or other factors. Misalignment of these parts is thereby prevented.

In another aspect, a flange plate may be coupled to an acoustic assembly and the coil wound around portions of this flange. In so doing, the coil is aligned with other parts of the assembly.

Advantageously, the use of the flanges provides improved alignment for the parts of the assembly than previous approaches. In another advantage, the shim (with which the flanges are formed) becomes part of the electrical terminal of the coil so that the input/output mechanism for the coil is ready-built into the assembly. In some aspects, the use of a magnetic yoke can be eliminated. In other aspects, a magnetic yoke can still be used.

In many of these embodiments, an acoustic apparatus includes a first acoustic element, a second acoustic element, and a registration portion. The first acoustic element and the second acoustic element are an element such as a coil, a reed, or a yoke. The registration portion is configured to register the first acoustic element with respect to the second acoustic element such that an exact and relative alignment and positioning between the first acoustic element and second acoustic element is provided and ensured.

In one aspect, the first acoustic element is a coil and the second acoustic element is a yoke. In other aspects, the registration portion includes a foldable shim, the shim includes flanges, and the flanges include at least one tine. In some aspects, the coil is wound about the at least one tine. In another aspect, the coil is inserted on the at least one tine.

In other examples, the registration portion includes a yoke locking flange. In some other examples, the first acoustic element is a coil and the second acoustic element is a reed.

In some aspects, the registration portion comprises at least one shim. In yet other aspects, the at least one shim is coupled to the coil, the at least one shim has a flange portion, and the flange portion defines a groove. In still other aspects, the reed passes through and is guided by the groove in the flange portion, and an exact and relative alignment and positioning between the coil and reed is provided and ensured by the at least one flange portion.

Referring now to FIGS. 1A-1E, one example of an acoustic assembly 100 (e.g., a balanced armature transducer) with a coil locating flange is described. The assembly 100 includes a base coil 102, a first shim 104, and a second shim 106. The shims 104 and 106 are coupled to the base coil 102, for example, by a heat activated adhesive (e.g., glue) or any other convenient attachment mechanism. Each of the shims 104 and 106 includes flanges 120. The flanges 120 form open grooves 122 through which a reed 108 is positioned. Portions 124 of the reed 108 pass through the grooves 122 of the shims 104 and 106. The central portion of the reed 108 passes through an opening 125 in the shims and also through an opening 126 of the base coil 102. The flanges 120 locate and/or position the coil 102 relative to a reed center line 129. The flanges 120 can be constructed of metalized plastic with metallization patterns provide the same termination and input/output from the coil. The shims can be used as a carrier for the coil, coil/reed, and additional downstream assemblies (e.g., a motor assembly)

Figure 1D:
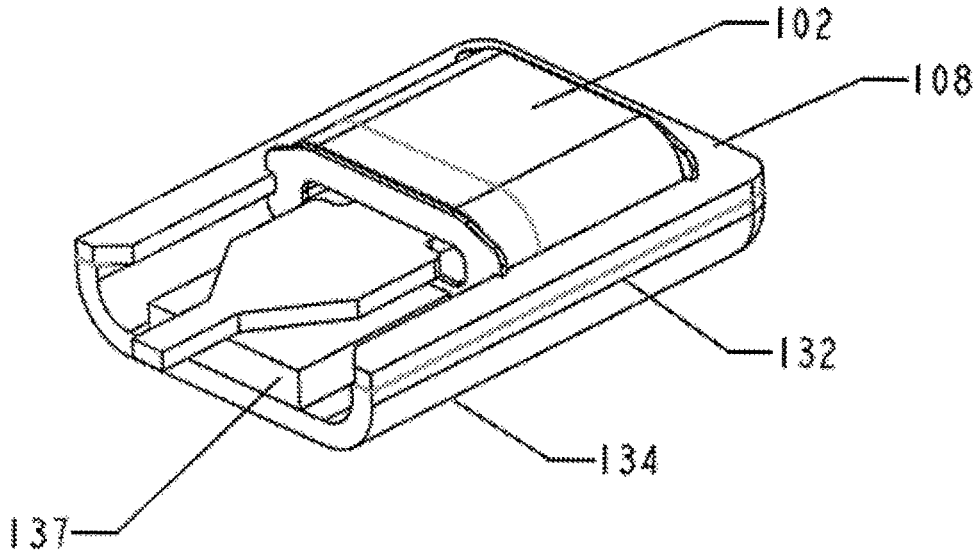
FIG. 1D is a perspective view of the base coil, shims, and reed of FIGS. 1A-1C, and with an enclosure according to various embodiments of the present invention.
Figure 1E:
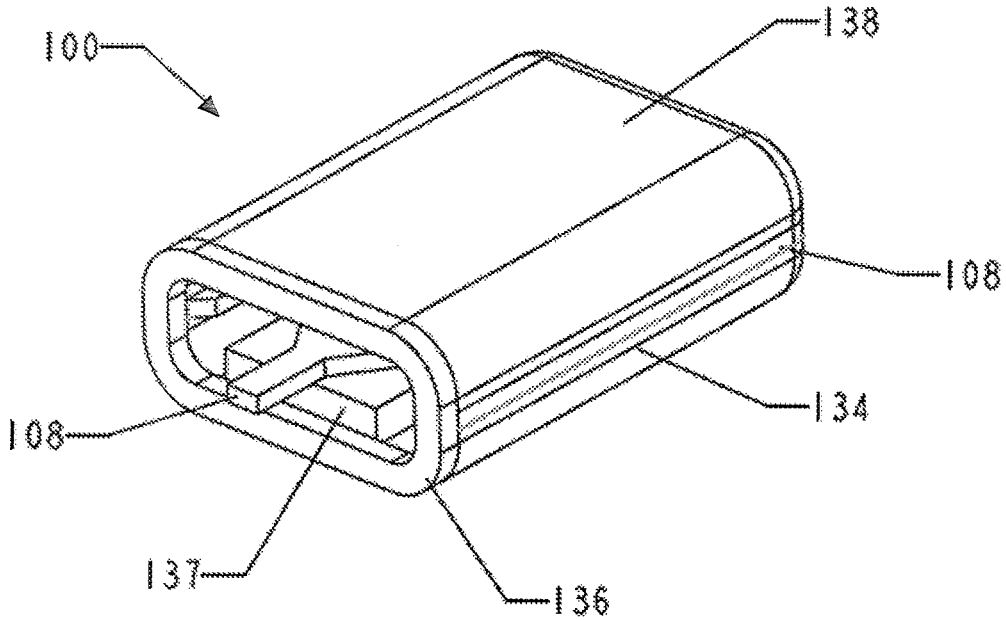
FIG. 1E is a perspective view of the base coil, shims, and reed of FIGS. 1A-1D, in a completely assembled acoustic assembly according to various embodiments of the present invention.
Figure 2A:
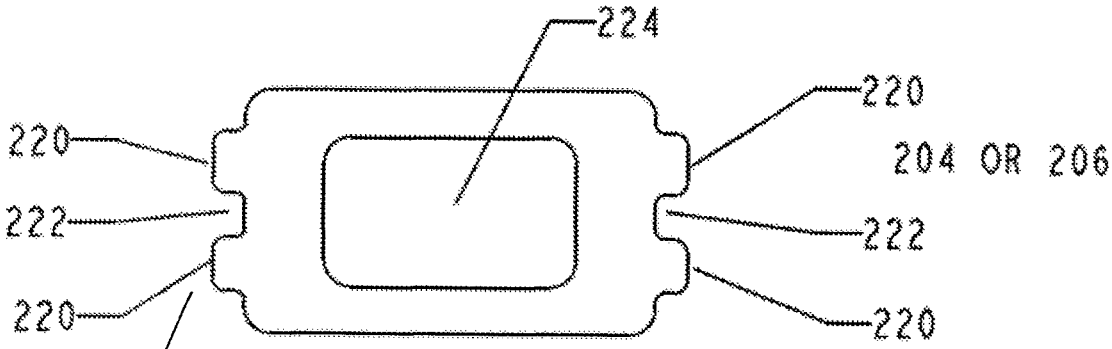
FIG. 2A is a front view of a shim with flanges according to various embodiments of the present invention.
Figure 2B:
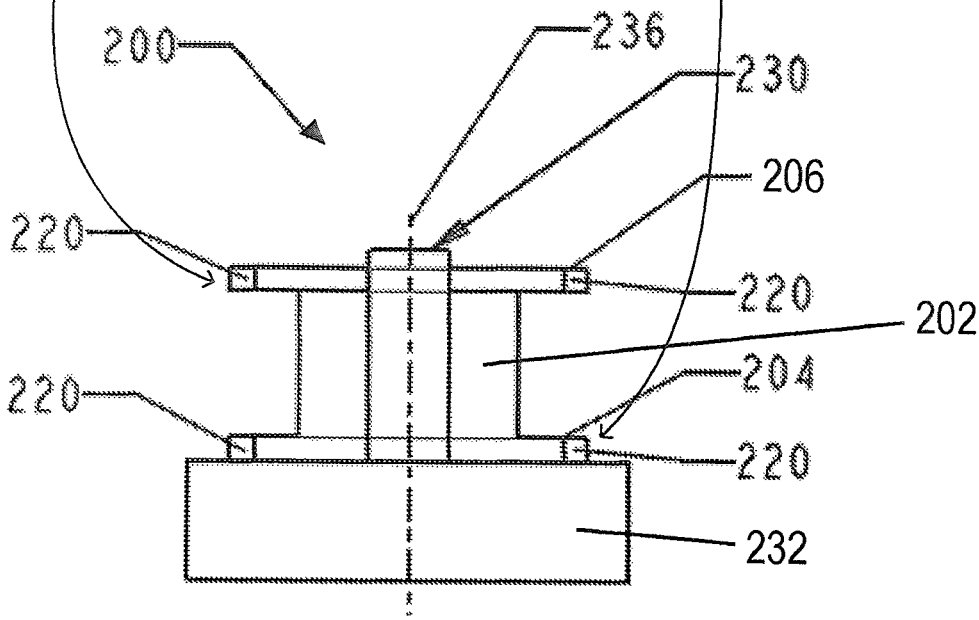
FIG. 2B is a side cut-away view of shims with flanges of FIG. 2A applied to a locating mandrill according to various embodiments of the present invention.
Figure 2C:
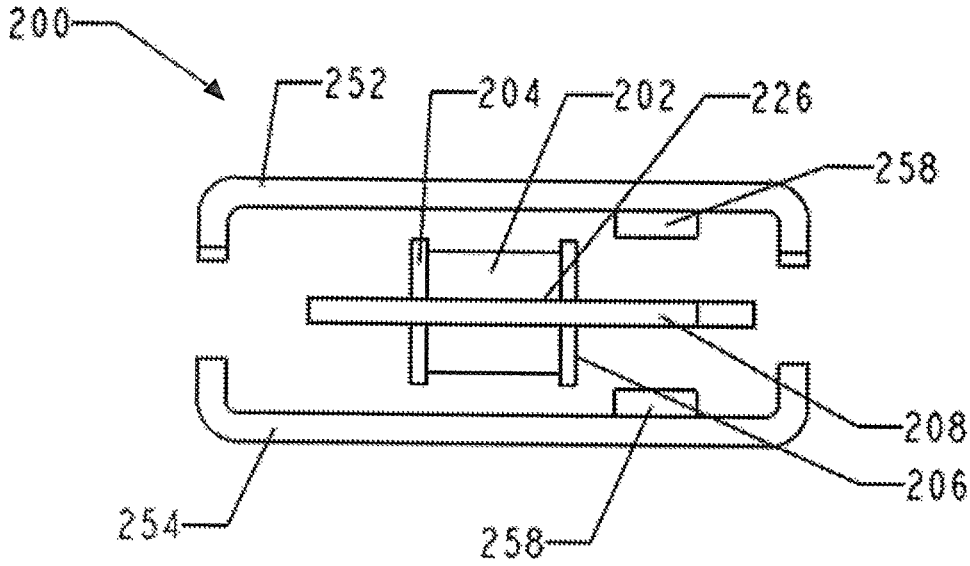
FIG. 2C is a side view of a completely assembled acoustic assembly during the assembly process according to various embodiments of the present invention.
Figure 2D:
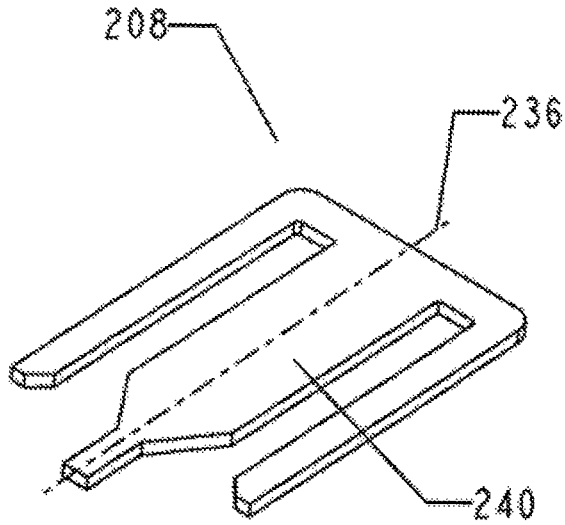
FIG. 2D is a perspective view of the reed used in FIG. 2C according to various embodiments of the present invention.
Figure 4A:
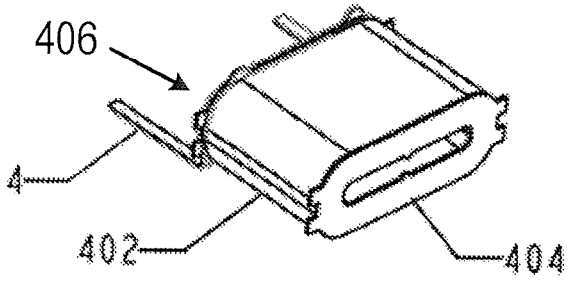
FIG. 4A is a perspective view of a base coil and shim in an acoustic assembly according to various embodiments of the present invention.
Figure 4B:
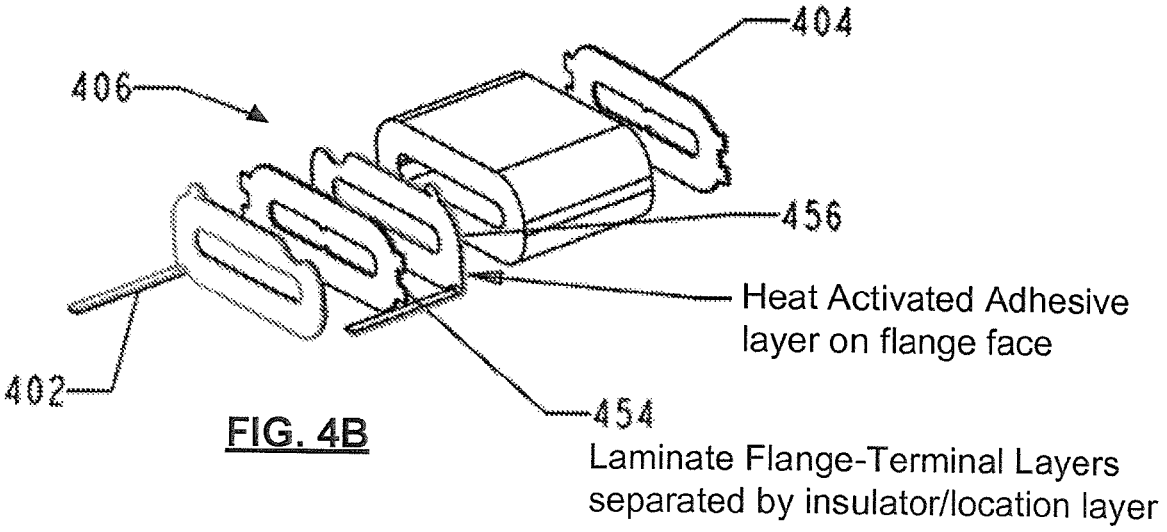
FIG. 4B is an exploded perspective view of a base coil and shim of FIG. 4A according to various embodiments of the present invention.
Figure 4C:
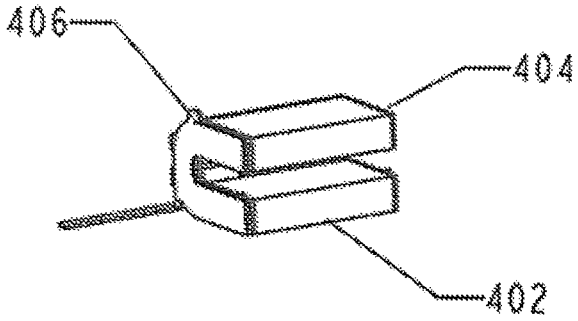
FIG. 4C is a section perspective view of a base coil and shim of FIGS. 4A-B according to various embodiments of the present invention.
Figure 4D:
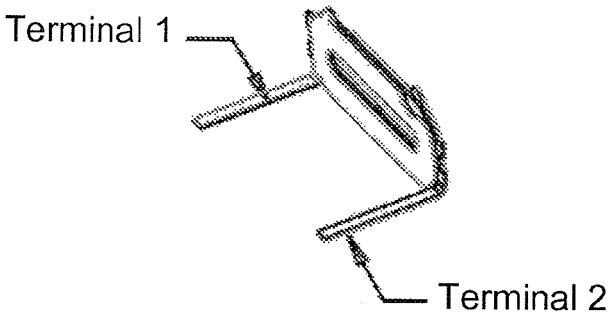
FIG. 4D is another perspective view of the compound flange used in FIG. 4A-C according to various embodiments of the present invention.

Referring now especially to FIGS. 1D and 1E, it can be seen that the 108 is positioned on a bottom portion 132 of a bottom enclosure assembly 134. The bottom closure assembly 134 has magnets 137 disposed thereon. A top enclosure assembly 138 is placed on top of the bottom enclosure assembly 134. A front cover portion 136 is attached to the bottom enclosure assembly 134 and the top enclosure assembly 138. It can be seen that portions of the reed 108 are exposed to the exterior of the assembly 100 and that no separate magnetic yoke is used.

From the example of FIGS. 1A-1E, it can be seen that an exact relative alignment and positioning between the coil 102 and the reed 108 is provided by the flanges 120. Put another way, the coil 102 is positioned at a known location relative to the center line 129 of the reed 108 no matter variations in size of the various components of the assembly 100. It can also be seen that the shims 104 and/or 106 can in part act as an electrical terminal with the coil 102 (e.g., a wire can be directly coupled to the shims, which are in turn electrically coupled to the coil 102). Special parts are not needed to make the electrical connections. In other words, input and output for the assembly 100 is already built in to the assembly 100.

Referring now to FIGS. 2A-D, an approach for assembling an acoustic device using a coil locating flange is described. An assembly 200 is created by sliding a first shim 204 down a central rod or mandrill 230 (resting on a base plate 232 and centered on an axis 236). The base coil 202 may then be wound around the rod or mandrill 230 and attached to the shim 204. Alternatively, a pre-wound coil may also be used. The shim 206 is slid on the top of the rod 230. A heat cure adhesive (e.g., glue) or any other convenient attachment mechanism can be used to attach the shims 204 and 206 to the coil 202.

Each of the shims 204 and 206 includes flanges 220. The flanges 220 form open grooves 222 through which a reed 208 is positioned. A portion 240 of the reed 208 also passes through openings 224 of the shims 204 and 206 and an opening 226 of the base coil. The flanges locate and/or position the coil relative to an axis 236, which is the reed center line.

The assembly 200 is placed between a first housing section 252 and a second housing section 254. Each of the sections 252 and 254 include magnets 258 coupled thereto or incorporated therein. For simplicity, other portions of the assembly are not shown.

As with the other examples herein, it can be seen that an exact relative alignment and positioning between the coil 202 and the reed 208 is provided by the flanges 220. Put another way, the coil 202 is positioned at a known location relative to the axis 236 no matter any variations in size of the various components of the assembly 200. It can also be seen that the shims 204 and/or 206 can in part act as an electrical terminal with the coil 202. Special parts are not needed to make the desired electrical connections. In other words, input and output for the assembly 200 is already built in to the assembly 200.

Referring now to FIGS. 3A-D, one example of an assembly that includes a magnetic yoke is described. An assembly 300 includes a base coil 302, a first shim 304, and a second shim 306. The shims 304 and 306 are coupled to the base coil 302, for example, by a heated adhesive (e.g., glue) or any other convenient attachment mechanism. Each of the shims 304 and 306 includes flanges 320. The flanges 320 form open grooves 322 through which a reed 308 is positioned. A portion of the reed 308 also passes through openings 324 of the shims 304 and 306 and an opening 326 of the base coil. The flanges locate and/or position the coil relative to a reed center line 336.

A yoke 370 extends around the reed. A yoke locking flange 372 locates and captivates the yoke 370. The yoke 370 includes magnets (not shown).

Again and as with the other examples herein, it can be seen that an exact relative alignment and positioning between the coil 302 and the reed 308 is provided by the flanges 320. Put another way, the coil 302 is positioned at a known location relative to the center line 336 of the reed 308 no matter variations in size of the various components of the assembly 300. It can also be seen that the shims 304 and/or 306 can in part act as an electrical terminal with the coil 302. Special parts are not needed to make the electrical connections. In other words, input and output for the assembly 300 is already built in to the assembly 300.

Referring now to FIG. 4, another example of an assembly is described. An assembly 400 includes a base coil 402, a first shim 404, and a second shim 406. The shims 404 and 406 are coupled to the base coil 402, for example, by a heated adhesive (e.g., glue) or any other convenient attachment mechanism. Each of the shims 404 and 406 has flanges 420. The flanges 420 form open grooves 422 through which a reed (not shown) is positioned. A portion of the reed also passes through openings 424 of the shims 404 and 406 and an opening 426 of the base coil. The flanges locate and/or position the coil relative to a center line 436.

The first shim 404 includes a first terminal layer 452, an insulator layer 454, and a second terminal layer 456. The first terminal layer 452 is a positive current path to the coil 402 that includes an electrical signal representing an audio sound. The second terminal layer 456 provides a return path from the coil 402.

Again and as with the other examples herein, it can be seen that an exact relative alignment and positioning between the coil 402 and the reed is provided by the flanges 420. Put another way, the coil 402 is positioned at a known location relative to the center line 436 of the reed no matter variations in size of the various components of the assembly 400. It can also be seen that the shims 404 and/or 406 can in part act as an electrical terminal with the coil 402. Special parts are not needed to make the electrical connections. In other words, input and output for the assembly 400 is already built in to the assembly 400.

Referring now to FIG. 5A-E, an example of an acoustic device that includes a foldable shim with flanges (yoke plate) is described. A yoke plate 502 includes an upper portion 504, a lower portion 506, a first bendable tine 508, and a second bendable tine 510. As shown especially in FIG. 5B, the tines 508 and 510 are bent so as to be perpendicular to the remainder of the flange 502.

Figure 5A:
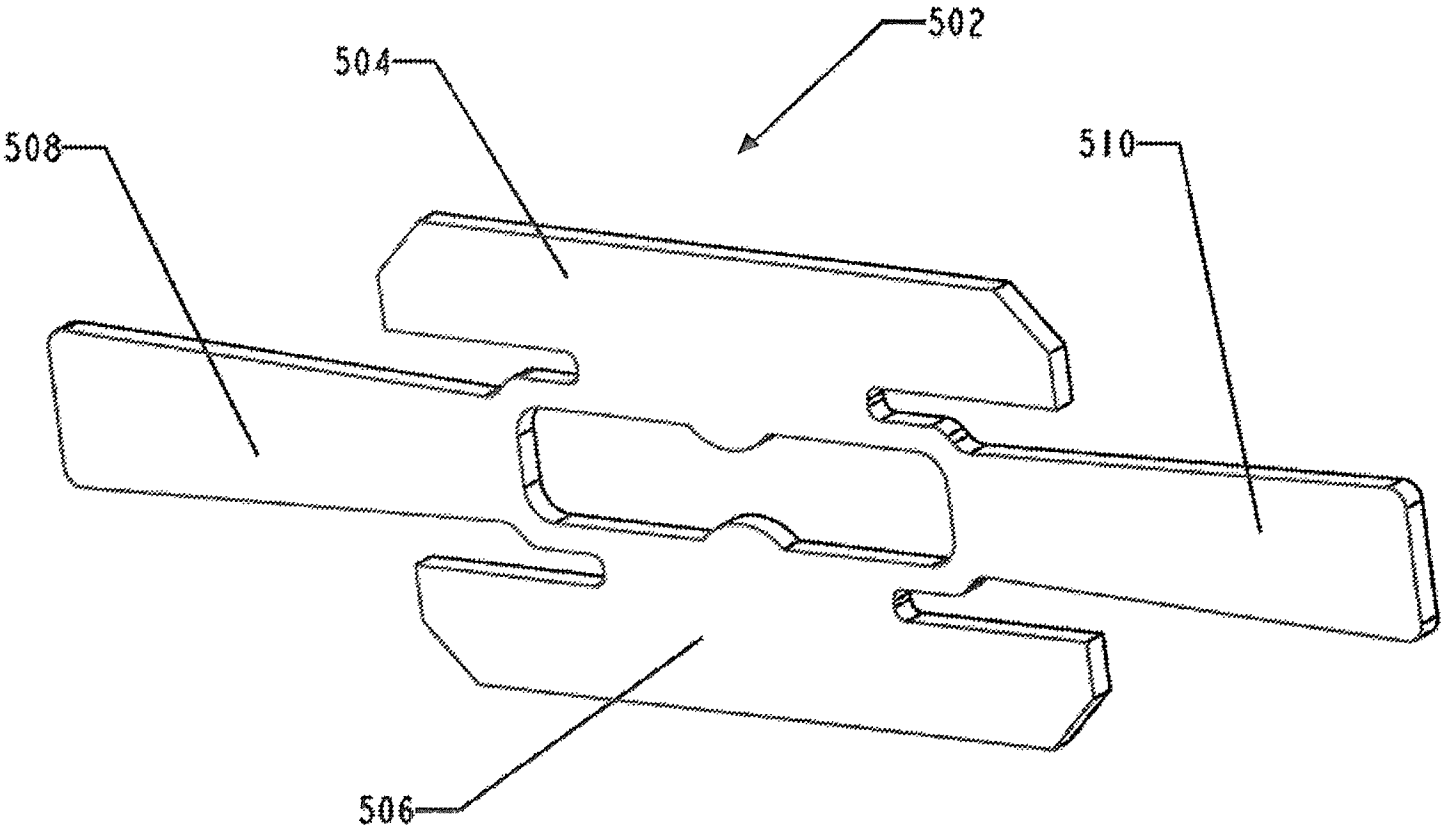
FIG. 5A is a view of a flange plate according to various embodiments of the present invention.
Figure 5B:
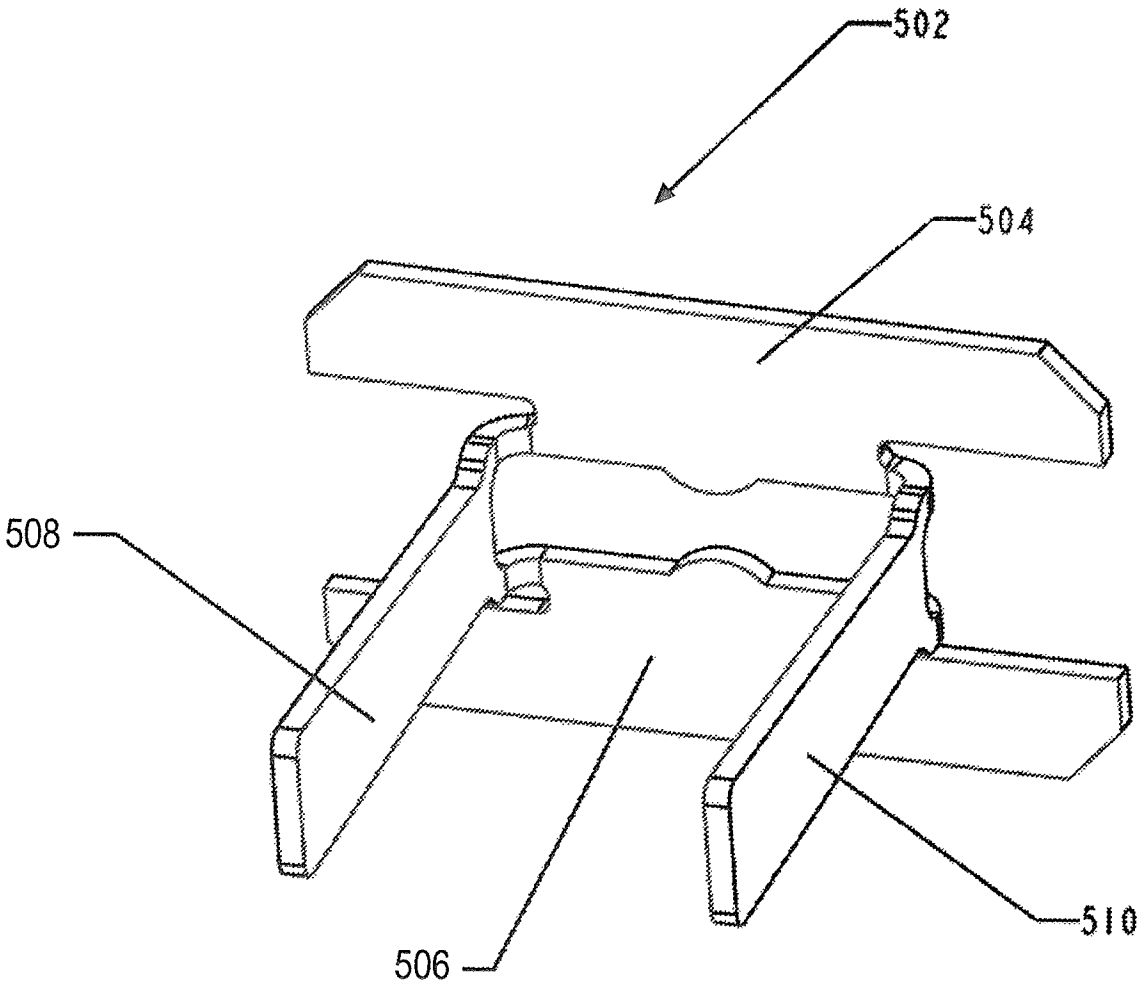
FIG. 5B is a view of a flange plate with the tines bent according to various embodiments of the present invention.
Figure 5C:
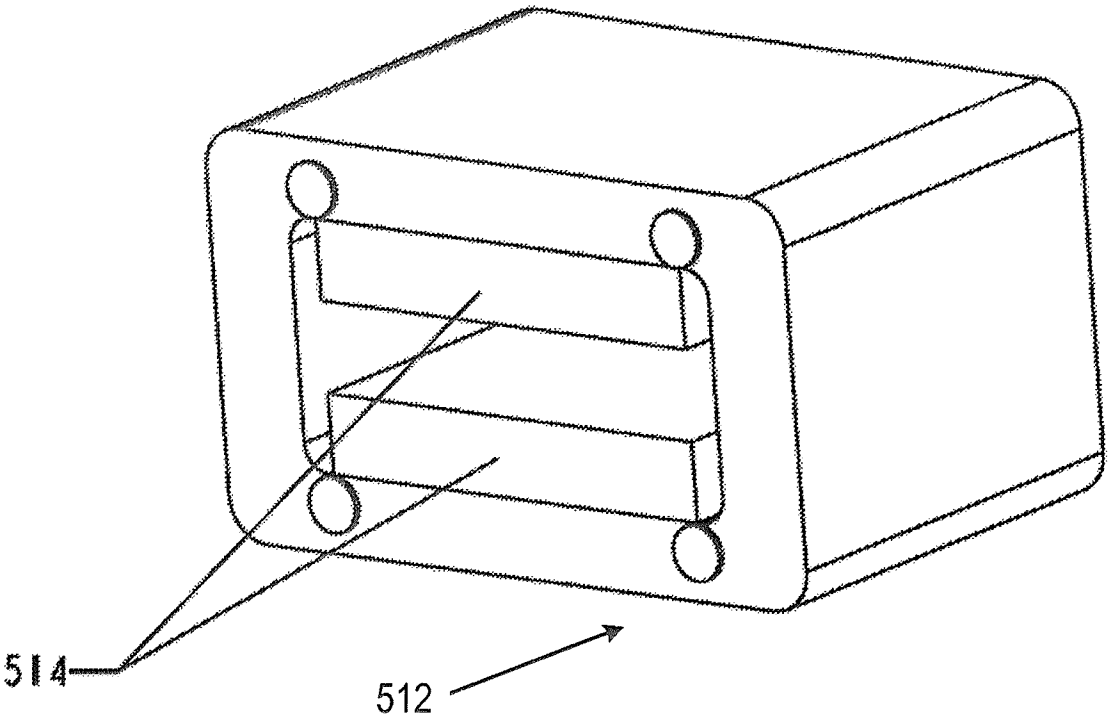
FIG. 5C is a view of a stack and magnet assembly according to various embodiments of the present invention.
Figure 5D:
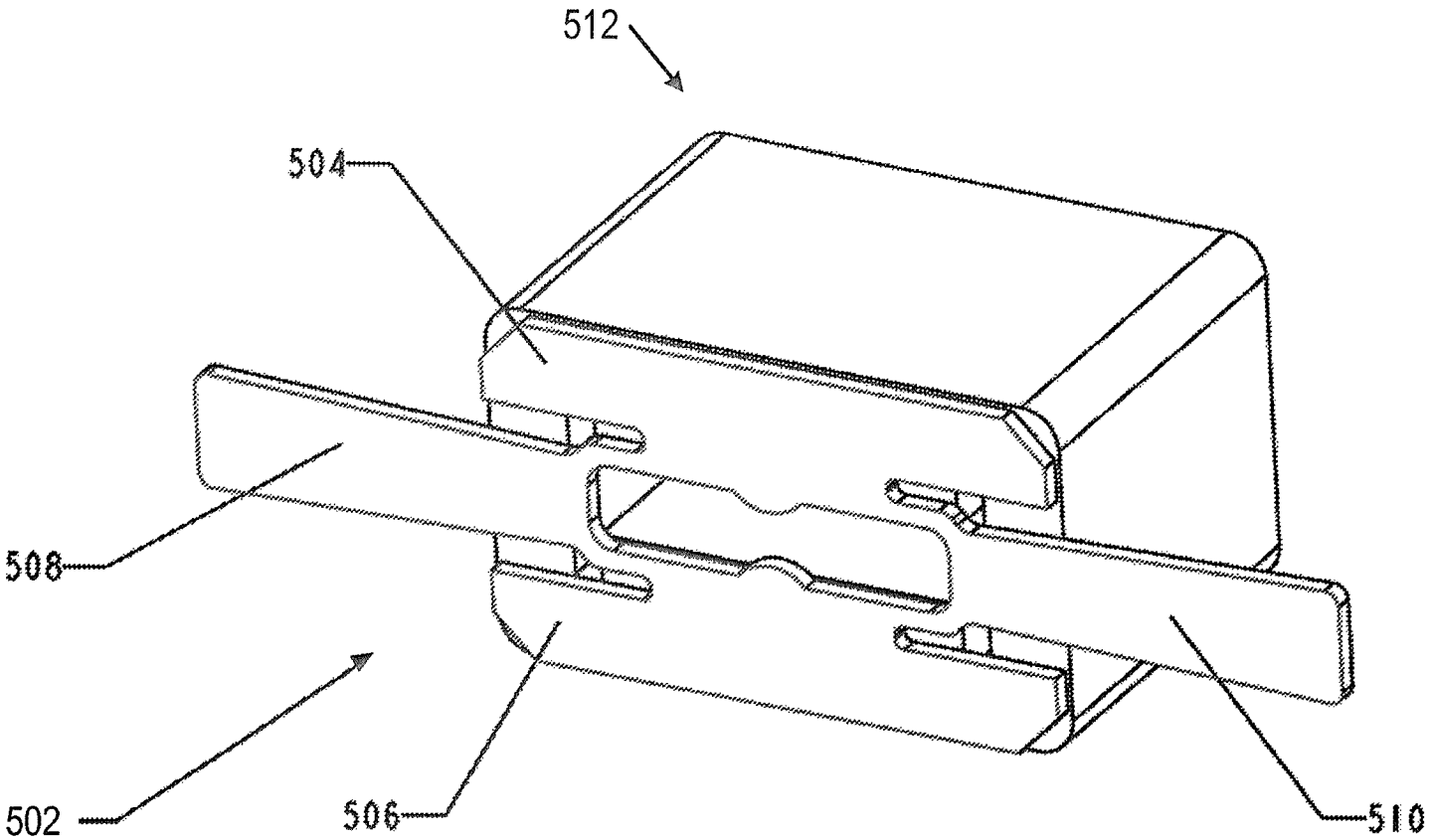
FIG. 5D is a view of a flange plate attached to the stack and magnet assembly according to various embodiments of the present invention.
Figure 5E:
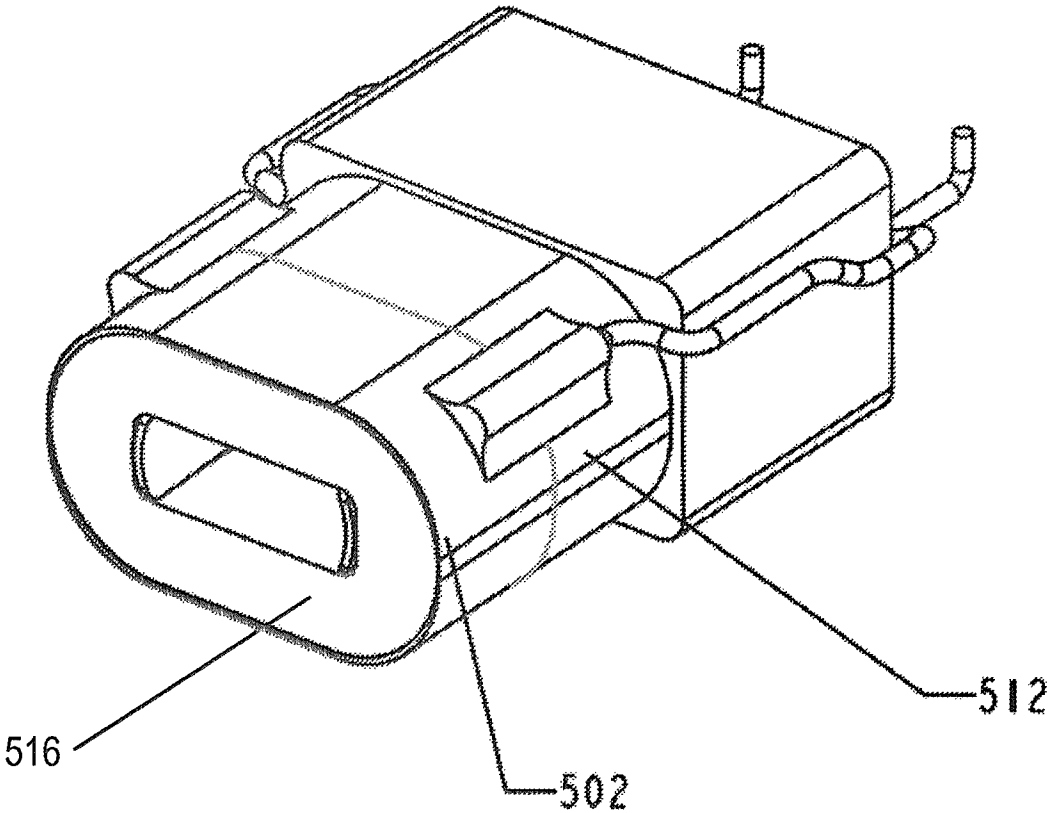
FIG. 5E is a view of the coil wound around the tines according to various embodiments of the present invention.

As shown especially in FIG. 5C, a stack 512 includes magnets 514. The magnets are inserted and these are laser welded to the stack 512. As shown in FIG. 5D, the assembly 502 is welded to the stack tube 512. As shown especially in FIG. 5E, a coil 516 is wound about the tines using, for example, thermo bonded P180 wire. The skeined leads (electrically coupled to the coil 516) are twisted and tinned after winding of the coil 516. In this way, the flange assembly 502 is indexed or registered with respect to the stack 512. Better centering of the coil 516 is achieved. An adhesive free joint between the stack 512 and coil 516 is also achieved. The coil has increased coil attachment strength because the coil is attached using a weld. The process can be automated or semi-automated saving human labor. Thus, instead of winding the coil and then attaching the shims to the coil to fixture the coil, a flange plate is attached to a magnetic yoke and the coil is wound and located using the flange plate.

Figure 5F:
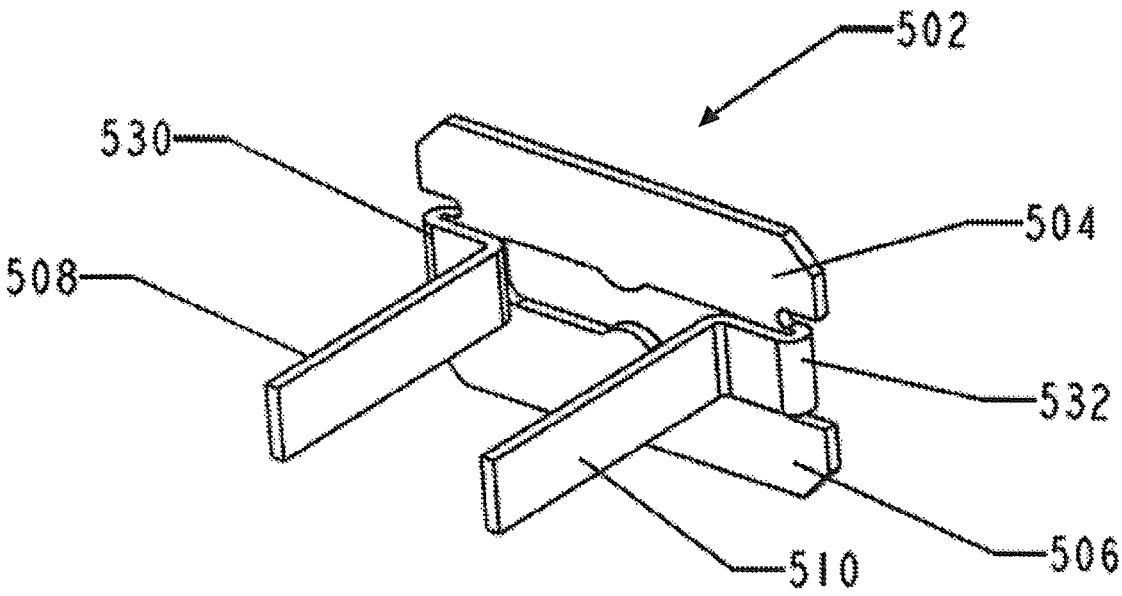
FIG. 5F is a view of a shim with flanges according to various embodiments of the present invention.

Referring now to FIG. 5F, another example of a foldable shim with flanges (yoke plate) is described. The foldable shim with flanges can be used in the acoustic devices described elsewhere herein. A yoke plate 502 includes an upper portion 504, a lower portion 506, a first bendable tine 508, and a second bendable tine 510. In one aspect, first bended portion 530 and a second bended portion 532 of tines 508 and 510 act as springs to allow the tines 508 and 510 to vibrate and shock or other forces are encountered and thereby dissipate shock or other forces as the acoustic device is subjected to these forces.

Figure 5G:
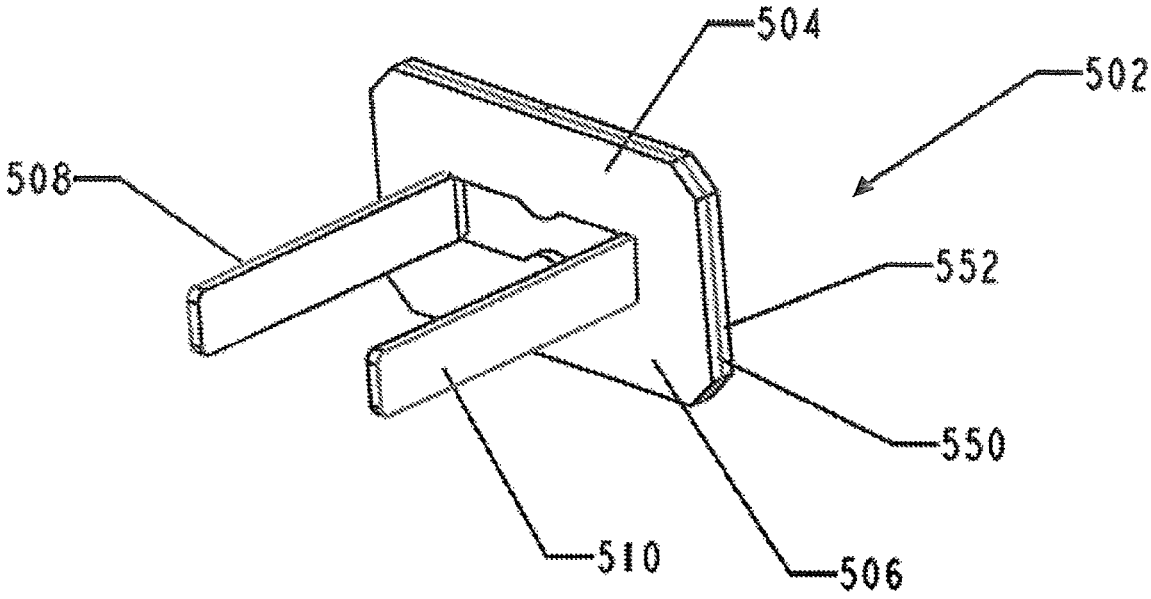
FIG. 5G is a view of a shim with flanges according to various embodiments of the present invention.

Referring now to FIG. 5G, another example of a foldable shim with flanges (yoke plate) is described. The foldable shim with flanges can be used in the acoustic devices described elsewhere herein. A yoke plate 502 includes an upper portion 504, a lower portion 506, a first bendable tine 508, and a second bendable tine 510. The upper and lower portions include a first plate 550 and a second plate 552. The two plates 550 and 552 give added strength to the apparatus. In another advantage, the plate 552 can be constructed of a non-conductive material (and the plate 550 constructed of a conductive material). Consequently, eddy currents are eliminated without the need for a gap as described with respect to FIG. 5H.

Figure 5H:
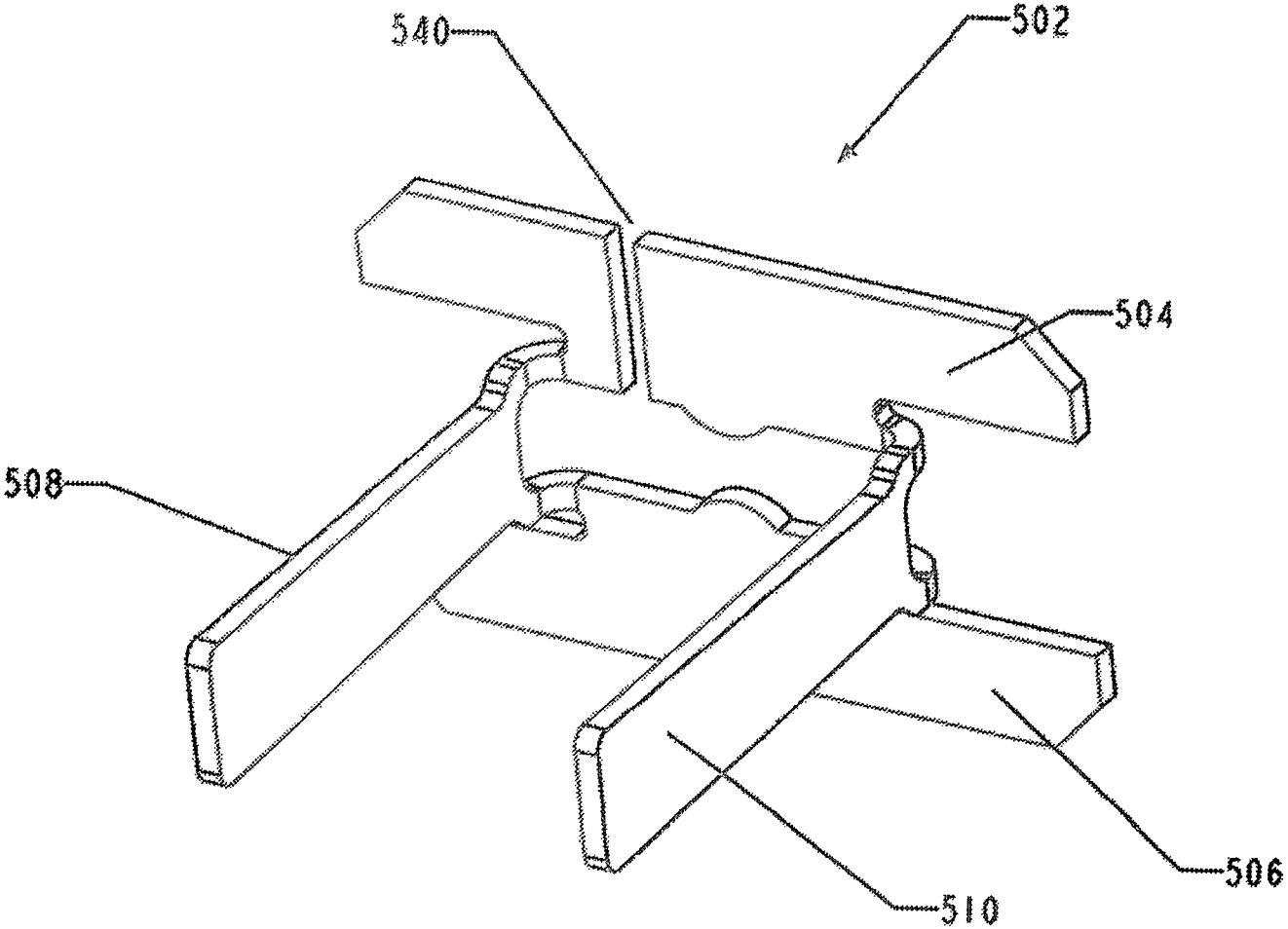
FIG. 5H is a view of a shim with flanges according to various embodiments of the present invention.

Referring now to FIG. 5H, yet another example of a foldable shim with flanges (yoke plate) is described. The foldable shim with flanges can be used in the acoustic devices described elsewhere herein. A yoke plate 502 includes an upper portion 504, a lower portion 506, a first bendable tine 508, and a second bendable tine 510. In this example, a gap 540 is formed in the upper portion 504. The gap 504 eliminates eddy currents in the flange. The gap 540 breaks the ring-like shape of the flange and in so doing eliminates eddy currents since currents cannot flow across the gap 540.

It will be appreciated that the elements described herein can be constructed of any appropriate metal or plastic and are not limited to a single material.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An acoustic apparatus, the apparatus comprising;

a first acoustic element;

a second acoustic element; and a registration portion that is configured to register the first acoustic element with respect to the second acoustic element such that an exact and relative alignment and positioning between the first acoustic element and second acoustic element is provided and ensured;

wherein the first acoustic element is a coil and the second acoustic element is a yoke;

wherein the registration portion comprises a foldable shim, the shim comprising flanges, the flanges comprising at least one tine;

wherein the foldable shim is coupled to a face of the yoke, and comprises a plate portion and at least one tine, the at least one tine and plate portion being generally perpendicular to the other;

wherein the coil is wound or inserted about the at least one tine.

2. The apparatus of claim 1 wherein the registration portion comprises a yoke locking flange.

3. The acoustic apparatus of claim 1, wherein the at least one tine comprises a first tine and a second tine.

4. An acoustic apparatus, the apparatus comprising;

a first acoustic element;

a second acoustic element; and a registration portion that is configured to register the first acoustic element with respect to the second acoustic element such that an exact and relative alignment and positioning between the first acoustic element and second acoustic element is provided and ensured;

wherein the first acoustic element is a coil and the second acoustic element is a reed;

wherein the registration portion comprises at least one shim;

wherein the at least one shim is coupled to the coil, the at least one shim has a flange portion, and the flange portion defines a groove; and wherein the reed passes through and is guided by the groove in the flange portion, and wherein an exact and relative alignment and positioning between the coil and reed is provided and ensured by the at least one flange portion.

* * * * *